US006434795B1

(12) United States Patent
Jourde et al.

(10) Patent No.: US 6,434,795 B1
(45) Date of Patent: Aug. 20, 2002

(54) METHOD FOR CONTROLLING THE PROFILE OF A NON-WOVEN LAP AND RELATED PRODUCTION INSTALLATION

(75) Inventors: Bernard Jourde, Elbeuf; Robert Jean, Fouqueville; Jean-Christophe Laune, La Saussaye, all of (FR)

(73) Assignee: Asselin, Elbeuf (FR)

( * ) Notice: Subject to any disclaimer, the term of this patent is extended or adjusted under 35 U.S.C. 154(b) by 0 days.

(21) Appl. No.: 09/980,338

(22) PCT Filed: May 31, 2000

(86) PCT No.: PCT/FR00/01518

§ 371 (c)(1),
(2), (4) Date: Dec. 3, 2001

(87) PCT Pub. No.: WO00/73547

PCT Pub. Date: Dec. 7, 2000

(30) Foreign Application Priority Data

Jun. 1, 1999 (FR) ..... 99 06891

(51) Int. Cl.[7] ..... D04H 5/08
(52) U.S. Cl. ..... 19/161.1; 19/163; 19/296
(58) Field of Search ..... 19/65 A, 98, 99, 19/106 R, 161.1, 163, 296, 300, 302; 28/101, 103

(56) References Cited

U.S. PATENT DOCUMENTS

| | | | | | |
|---|---|---|---|---|---|
| 314,369 | A | * | 3/1885 | Dolge | 19/161.1 |
| 4,107,822 | A | * | 8/1978 | Brown | 19/163 |
| 4,375,448 | A | * | 3/1983 | Appel et al. | 264/121 |
| 4,662,032 | A | | 5/1987 | Thorbjoernsson | |
| 5,060,347 | A | * | 10/1991 | Beckers | 19/163 |
| 5,325,571 | A | * | 7/1994 | Bolliand | 19/302 |
| 5,400,475 | A | * | 3/1995 | Hille | 19/163 |
| 6,189,185 | B1 | * | 2/2001 | Bioul et al. | 19/161.1 |
| 6,195,844 | B1 | * | 3/2001 | Jourde et al. | 19/161.1 |

FOREIGN PATENT DOCUMENTS

| | | |
|---|---|---|
| EP | 0 032 044 | 7/1981 |
| FR | 2 770 855 | 5/1999 |
| JP | 11-012857 | 4/1999 |

* cited by examiner

*Primary Examiner*—Danny Worrell
*Assistant Examiner*—Gary L. Welch
(74) *Attorney, Agent, or Firm*—Young & Thompson

(57) ABSTRACT

An installation includes a carding machine (1), and a distributor-layer (2) depositing the card (1) web (6) in a reciprocating motion on a delivery belt (8) moving transversely. The resulting intermediate lap (16) is conveyed to a needling loom (3) to produce a consolidated lap (24). A measuring station (28) scans the consolidated lap (24) profile and transmits it to a processing unit (32) where the profile is compared to a set reference input by a terminal (33). The variations in width cause a corresponding modification in the width deposited by the distributor-layer (2) by a link (36). The local surface weight variations cause a corresponding modification of the controls applied to the carding machine (1) capable of longitudinally profiling the web (6). The invention is useful for controlling an installation for obtaining a finished product.

27 Claims, 3 Drawing Sheets

1
2
3
4
6
7
8
16
23
24
26
27
28
29
31
32
33
34
36
37
57
58
61
62
63
64
II
III
IV
V
XIV

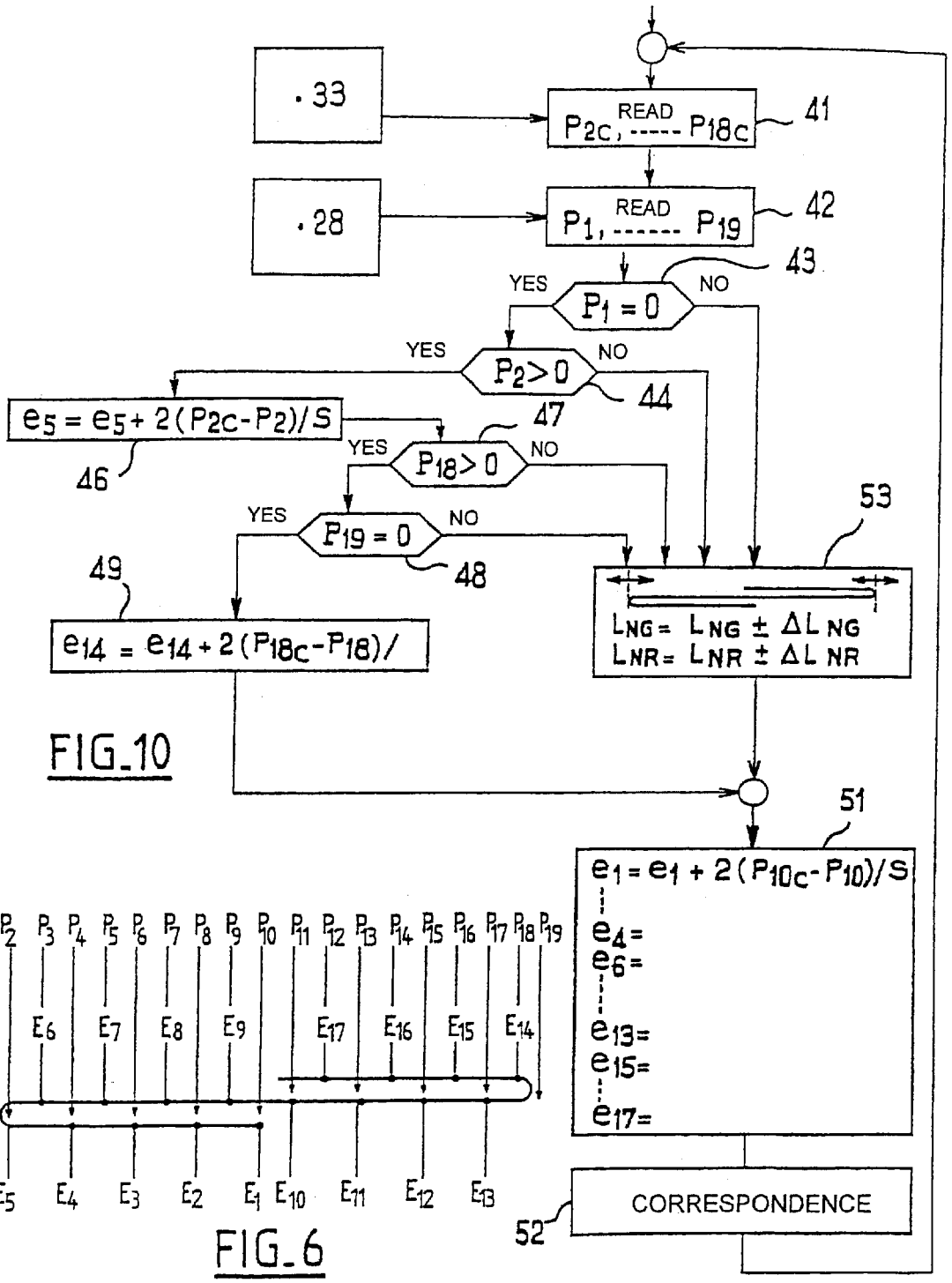
FIG_10
FIG_6
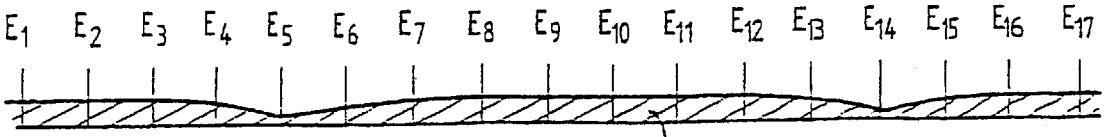
FIG_9

FIG. 5
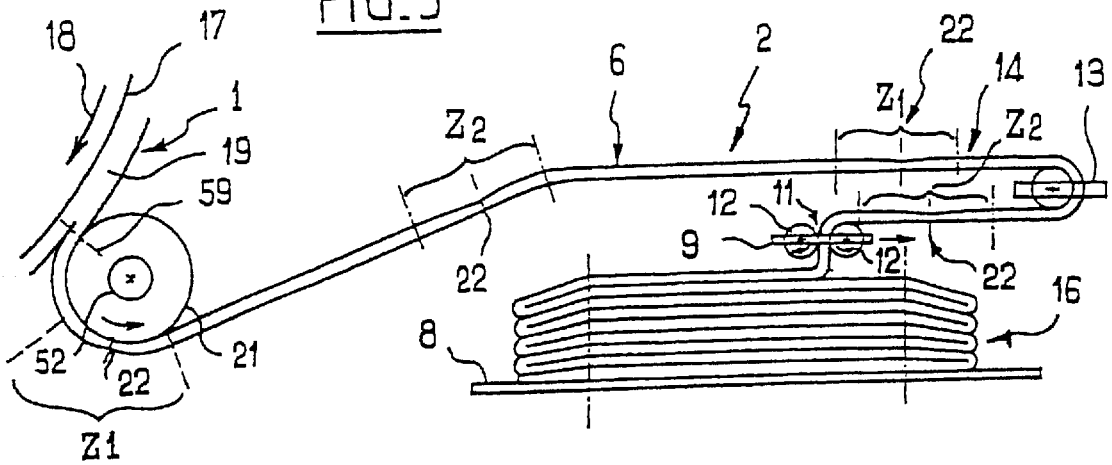
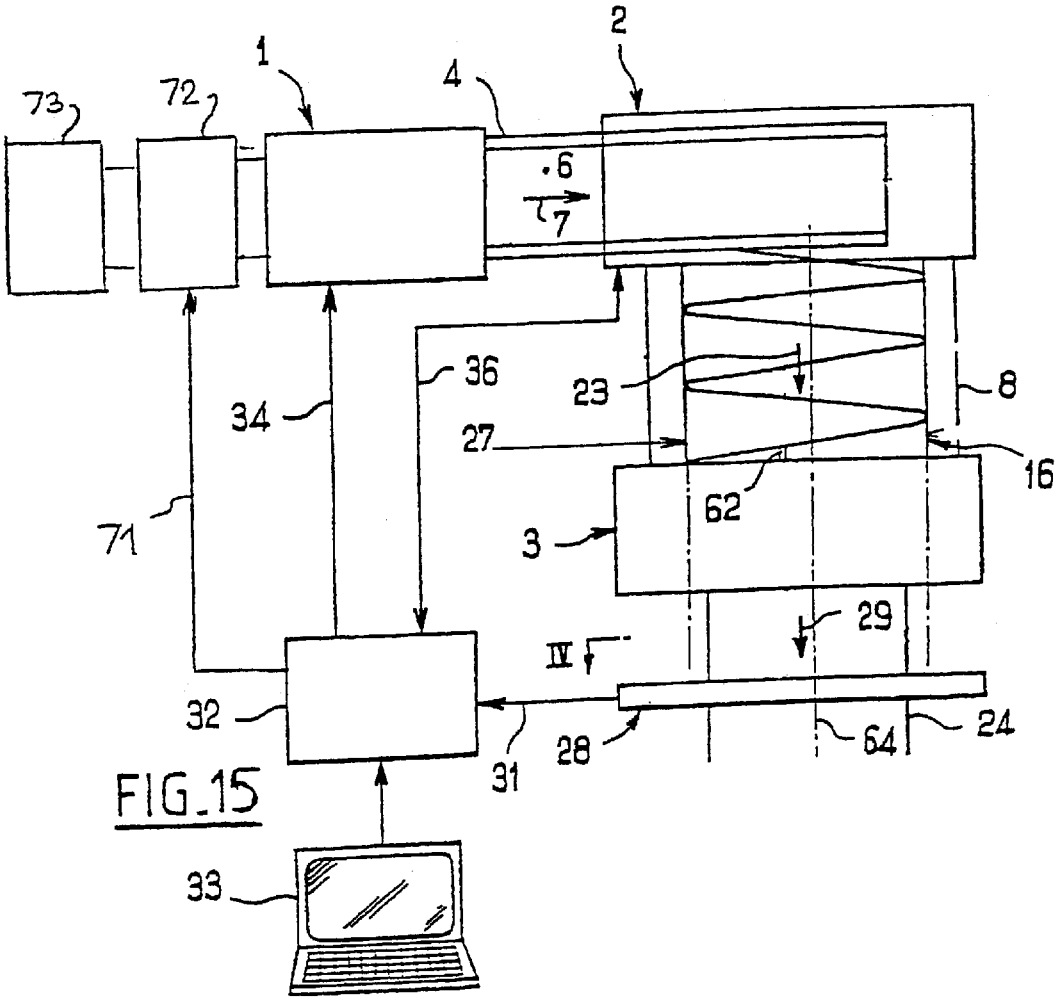
FIG. 15

METHOD FOR CONTROLLING THE PROFILE OF A NON-WOVEN LAP AND RELATED PRODUCTION INSTALLATION

FIELD OF THE INVENTION

The present invention concerns a method for controlling the profile of a non-woven fleece.

The present invention also concerns an installation for production of a fleece of non-woven fibres.

BACKGROUND OF THE INVENTION

It is known to produce a fibrous product, such as a fleece web, in a carding machine or other apparatus such as, for example, a pneumatic fleecing machine. The fibre web thus obtained is fed into a crosslapper in which the web is alternately folded one way and the other on a delivery belt. The fleece is thus made up of web segments inclined alternately one way and the other, which overlap. The folds between successive segments are aligned along the lateral edges of the fleece produced.

The fleece of fibres which is obtained is generally intended for subsequent consolidation processing, for example by needling, by coating and/or etc. to obtain a consolidated non-woven product.

FR-A-2 234 395 teaches the speed ratios that must be complied with in the crosslapper to control the thickness of the fleece at any point across its width.

DE-C-1 287 980 teaches placing directly at the exit of the crosslapper, above the longitudinal axis of the fleece, a gauge 32 which detects defects in thickness/surface weight of the fleece along its axis. This detection is received by a processing device which, in case of a discrepancy from a set reference, corrects in particular the speed of the delivery belt of the crosslapper when an incorrect overlapping of the web segments forming the fleece produces transverse wads or, conversely, gaps in the form of transverse grooves in the fleece. In case of a deviation of the thickness of the fleece relative to a set reference, the processing device orders a corresponding variation in the rotation speed of the doffer of the carding machine which is installed upstream of the crosslapper.

EP-A-0 315 930 proposes a crosslapper producing a fleece having, in cross-section, a non-uniform thickness/surface weight profile. To this end, the lapper carriage, which deposits the web at a variable point on the width of the delivery belt, is actuated at a speed which varies in relation to the speed of the belts which eject the web across this carriage to deposit it on the delivery belt of the crosslapper. If, at a given position on the fleece width, the carriage moves at a speed higher than that at which it feeds the fibre web, the fibre web is stretched, and this reduces the thickness of the fleece at that place. If, on the other hand, the carriage speed is below the feeding speed, the fibre web is deposited in a compressed form, which increases the thickness of the fleece at that point.

EP-B-O 371 948 describes a method intended to pre-compensate for the defects occurring during subsequent consolidation, in particular needling, by locally varying the thickness of the web introduced into the crosslapper. This is achieved by automatically controlling the speed of a doffer of the carding machine relative to the speed of the carding drum. The more quickly the doffer turns relative to the drum, the more the surface weight of the fibre web formed by the doffer is reduced.

FR-A-2 770 855 describes various improvements to this process and proposes modified embodiments combining modulation of the longitudinal profile of the fibre web produced by the carding machine or like apparatus with a stretching and/or compression action of the fibre web as it leaves the lapper carriage of the crosslapper.

A computer-controlled processing device enables the user to input a reference profile desired for the fleece and then commands the fibre web production equipment and/or the crosslapper in a manner which is calculated in view of realization of the requested profile. In practice, the user of the installation attaches decisive importance to the profile of the consolidated fleece obtained. This profile is inevitably modified by functional imperfections of the crosslapper and of the consolidation machine, notably when the latter is a needling loom. Needling looms perform the function of interlacing the fibres. At the same time they have the disadvantage of reducing the transverse dimension of the fleece and providing a fleece that is thicker along the edges than in the median zone.

The installations described in EP-B-O 371 948 and FR-A-2 770 855, as well as the crosslapper described in EP-A-0 315 930, in principle make it possible to give the fleece leaving the crosslapper a non-uniform profile which pre-compensates for the defects which will be produced by the needling loom. But in practice, perfect pre-compensation is very difficult to achieve, necessitating laborious adjustments. Moreover, it is not certain that a good initial adjustment will suffice in the long term to obtain a consolidated product in conformity with the expected ideal profile.

SUMMARY OF THE INVENTION

The object of this invention is thus to propose a method and a production installation which makes it possible for the user to obtain, more simply and more reliably, the profile desired for the consolidated fleece.

According to a first aspect of the invention, the method for controlling the transverse profile of a non-woven fleece in an installation for production of said fleece, in which, at a measuring station, a physical magnitude of the fleece is detected and on the basis of this detected value the profile of the fleece is corrected by adjusting an operation parameter of at least one fibre-arranging unit situated in the installation upstream of the measuring station, is characterized in that

- at the measuring station the physical magnitude is detected at several points across the fleece width so as to record a transverse profile of the fleece;
- in case of a discrepancy between the profile recorded and a reference profile, the operation parameter is corrected when said unit is working the fibres which will be located at the point on the fleece width where the profile discrepancy appeared.

"Fibre-arranging unit" is the term applied to a unit belonging, for example, to a carding machine or a crosslapper and which has an effect on the arrangement or distribution of the fibres in the fibre web or the fleece, and which has an influence in particular on the surface weight of a "fibre web cross-section" or of a point on the fleece width. "Fibre web cross-section" is the term applied to a transverse section of a fibre web or other fibrous product at a specific point along its length. This cross-section is characterised in particular by its surface weight, which can vary from one cross-section to another.

With the invention, the transverse profile obtained is continually or intermittently checked, and targeted corrections are carried out if there is a discrepancy between a point on the profile obtained and the corresponding point on the reference profile.

The correction can be carried out using a method known per se according to EP-A-O 315 930, EP-B-0 371 948 or FR-A-2 770 855.

The physical magnitude which is measured can be chosen from a wide range. For example, the permeability of the fleece to a given radiation can be measured. This permeability constitutes a physical magnitude representative of the local surface weight.

The method described in FR-A-2 770 855 requires precise knowledge of the "delay length", i.e. the length of fibre web between a first fibre web cross-section in the process of being deposited on the fleece being formed in the crosslapper, and a second fibre web cross-section located at the point on the fibres path, where adjustment of the specific weight is carried out upstream of the crosslapper, in particular in the carding machine. If the fibre web is subjected to stretching or compression between these two cross-sections, a correspondingly corrected delay length must be taken into account. The corrected delay length corresponds to the total running length travelled by the lapper carriage above the delivery belt between the time-point when it deposits the first cross-section mentioned and the time-point when it deposits the second cross-section mentioned. By knowing this delay length, possibly corrected, one knows the point at which a fibre web cross-section undergoing thickness/surface weight correction in the carding machine will be deposited in the fleece width.

The delay length, possibly corrected, can be theoretically determined at any time in a given production installation, programmed in a given way. In practice such a theoretical determination can be difficult to implement and may not produce a perfect result. It is especially difficult to take into account certain elements such as the elasticity of the fibres, which risk being stretched or, conversely, becoming recompressed at certain points in their path.

According to an aspect of the invention which can, independently of profile control, provide a useful addition to FR-A-2 770 855, the delay length is determined experimentally, or at the very least the theoretically determined value is experimentally finalized. For this purpose, an initialization step is implemented with the help of a particular feature of the fibrous product, whose longitudinal position is determined along the fibrous product when travelling through said fibre-arranging unit, and whose transverse position is then determined in the fleece produced. Thanks to this more precise knowledge of the delay length, the profile-control method according to the invention can be more effectively implemented.

Advantageously this particular feature is a pseudo-defect generated by the arranging unit. It is also advantageous for the particular feature, notably the pseudo-defect, to be detected by the means for detecting the physical magnitude. In view of this, the initialization process forms a still more advantageous combination with the profile-control method per se.

Knowing the length of fibre web necessary to feed the lapper carriage during a reciprocation of the latter, it is possible to deduce therefrom all the successive fibre web cross-sections that will correspond to the same transverse position on the fleece. And it will be possible to deduce therefrom the position of the fibre web cross-sections corresponding to any other transverse position on the fleece.

In practice, at the same time that the passage of the particular feature is determined at its passage across the arranging unit, the position of the lapper carriage in its reciprocatory cycle can be determined. Then, each time the lapper carriage passes this position in its cycle again, it will be known that the fibre web cross-section being worked by the arranging unit is intended to settle in the aforesaid transverse position of the fleece.

In an improved version, the initialization can advantageously comprise a step consisting of phase-shifting the successive particular features in relation to the reciprocatory cycles of the lapper carriage, until these successive particular features are located in a particular position on the fleece width, and notably on the central axis of the fleece.

The fibre web cross-sections which will be located on the central axis of the fleece have thus been determined.

By simple subdivision of the length of the fibre web between two such successive sections, fibre web cross-sections are found which will be located at different points across the fleece width. This subdivision can be carried out in a deliberately irregular manner, to take account, for example of non-constant stretching/compression on leaving the lapper carriage.

Once initialization is completed, the production step begins, and there is then no longer any need to provide the fibre web with "particular features" or "pseudo-defects". When a correction is to be made to the transverse profile of the fleece, this correction is made on the fibre web, in a fibre web cross-section chosen by reference to the fibre web cross-sections which are known to be located along the fleece axis.

The correction can also be carried out by modifying the speed ratio between the lapper carriage (then becoming the fibre-arranging unit, serving to apply the correction) and the speed of movement of the fibre web across the lapper carriage when the lapper carriage is located above the point on the fleece width where the profile discrepancy was found. This method has the advantage of necessitating no determination between the longitudinal positions on the fibre wed and the transverse positions on the fleece, but can have the disadvantages referred to in FR-A-2 770 855 in connection with EP-A-0 315 930, in particular relatively poor effectiveness of correction when using relatively elastic fibres.

It is therefore preferred according to the invention to make surface-weight corrections during production of the fibre web upstream of the crosslapper. On the other hand, it is advantageous to correct the width of the fleece obtained when it deviates from the reference width, by adjusting the end-points of the path—or stroke—travelled by the lapper carriage of the crosslapper.

In this case also, the lapper carriage is a fibre-arranging unit which can be acted upon to apply a correction to the profile within the scope of the control method.

The corrections made can have the effect of modifying the position of the lapper carriage for which the fibre web cross-section intended to be located on the fleece axis travels through the fibre-arrangement unit. The said position of the lapper carriage can then be recalculated by applying to the position previously known a variation theoretically calculated from the foreseeable effects of the correction.

According to another aspect of the invention, the installation for production of a non-woven fibre fleece, comprising fibre-arranging units, detection means for measuring a physical magnitude of the fleece moving at a measuring station, and control means receiving a signal provided by the detection means and delivering to at least one of the arranging units, a modified control signal in case of a discrepancy between the physical magnitude read and a reference value, is characterized in that:

the detection means are designed to measure the physical magnitude at different points across the fleece width;

the control means compare the physical magnitude of each point with a reference value related to this point, and in case of a discrepancy at a point, apply a corrected command when the arranging unit is working fibres intended to be located at said point.

Further features and advantages of the invention will become clear from the following description, which relates to non-restrictive examples.

BRIEF DESCRIPTION OF THE DRAWINGS

In the appended drawings:

FIG. 5 is a schematic view across V—V in FIG. 1;

FIG. 6 is a schematic view of the fibre web deposited during one movement cycle of the lapper carriage, with the rule of correspondence between the fibre web cross-sections $E_1$ to $E_{17}$ and the measurement points $P_1$ to $P_{19}$;

FIG. 9 is lengthwise cross-sectional view of the corresponding fibre web to be produced to obtain this profile;

FIG. 10 is an example of a flow-chart for implementation of the method;

FIG. 15 is a schematic view of another embodiment of the invention

DETAILED DESCRIPTION OF THE INVENTION

Figures 1, 2, 3, 4, 7, 8, 11, 12, 13, 14:
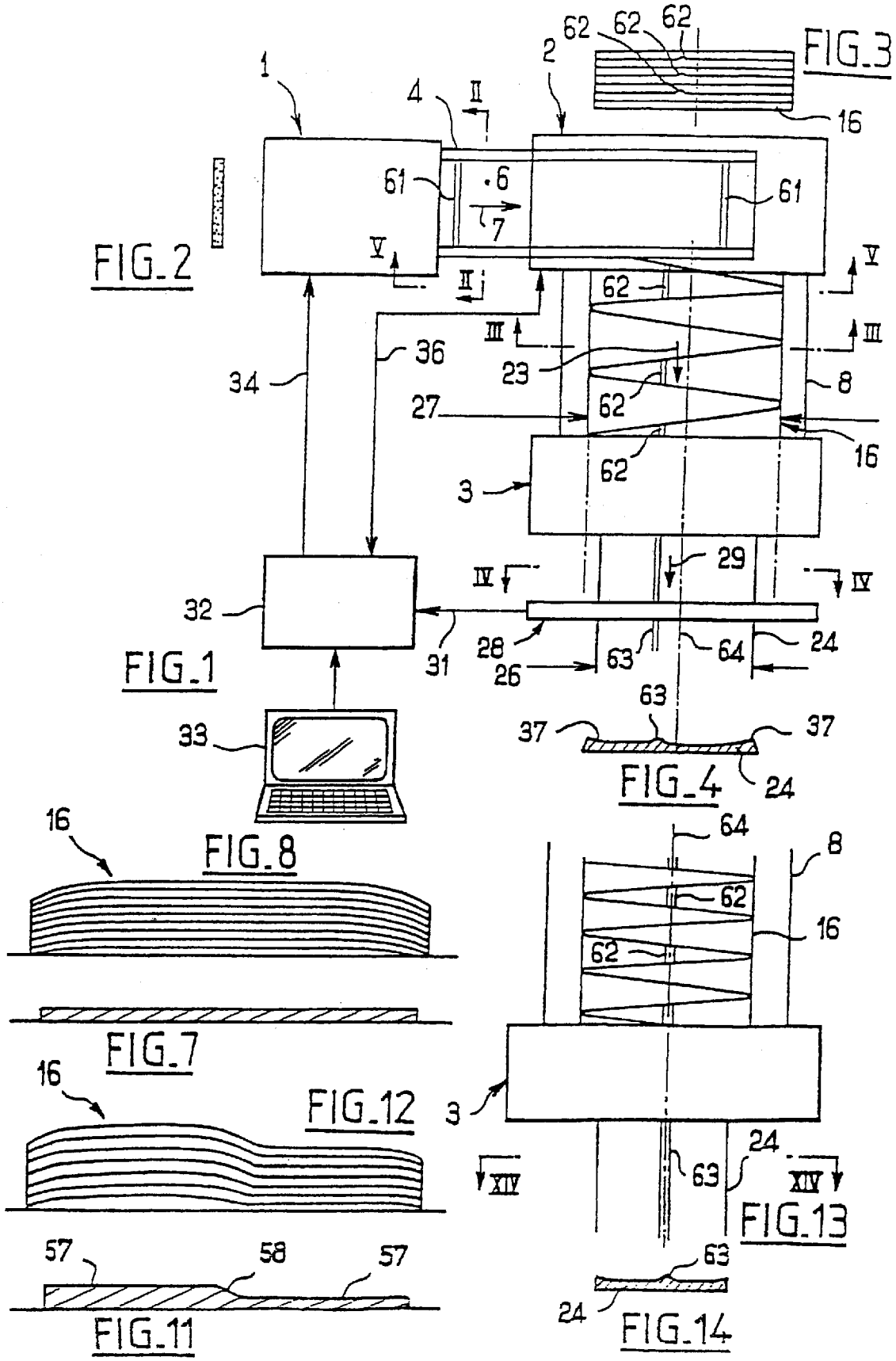
FIG. 1 is a plan view of an installation according to the invention.
FIGS. 2, 3 and 4 are cross-sectional views through II—II, III—III and IV—IV respectively in FIG. 1, showing the product at different stages of its preparation.
FIG. 7 is an example of a reference profile.
FIG. 8 is a cross-sectional view of the corresponding intermediate fleece.
FIGS. 11 and 12 are similar to FIGS. 7 and 8 but relate to another profile example.
FIG. 13 corresponds to part of FIG. 1, but at the end of the initialization step.
FIG. 14 is a cross-sectional view of the consolidated fleece through XIV—XIV in FIG. 13.

It should be pointed out here that the drawing figures are purely illustrative and claim to show neither implementation details nor the real proportions of the installation or its components.

In the example represented in FIGS. 1 and 5, the installation comprises a carding machine 1, a crosslapper 2 and a needle loom 3. The carding machine 1 will deliver onto a transfer belt 4 a fibre web 6 on which the fibre are in a generally longitudinal orientation with respect to the transfer direction 7.

The function of the crosslapper 2 is to receive the fibre web 6 following the direction 7 and to arrange it in zig-zag fashion on a delivery belt 8 moving perpendicular to the direction 7. The crosslapper comprises a lapper carriage 9 (FIG. 5) which reciprocates above the delivery belt 8 parallel to the width thereof. Above the delivery belt 8, the lapper carriage 9 has a slot 11 through which the fibre web 6 is ejected at a specific speed and is deposited at a variable point across the width of the delivery belt 8. In the example represented, the slot 11 is defined between two rollers 12 whose axes are situated in the same horizontal plane. The crosslapper also comprises a storage carriage 13 reciprocating above and parallel to the lapper carriage 9. The function of the storage carriage 13 is to cause the fibre web 6 to run along a loop 14 of variable length, allowing the fibre web to be ejected by the lapper carriage 11 at a speed which can be chosen freely and in particular independently of the speed of the reciprocatory movement of the lapper carriage 9 and the speed at which the fibre web 6 arrives from the carding machine 1. However, the average speed at which the fibre web arrives from the carding machine and the average speed at which the fibre web 6 is ejected by the lapper carriage 9 are equal throughout a reciprocatory cycle of the lapper carriage.

In FIG. 5, numerous details of the crosslapper 2 have not been represented, in particular the structure supporting and guiding the carriages 9 and 13, the motors for driving them, as well as various belts supporting the fibre web up to its exit through the slot 11 of the lapper carriage 9. Such elements are described in detail for example in EP 0 517 563.

Simultaneous examination of FIGS. 1 and 5 makes it possible to understand that, depending on the speed of the reciprocatory movement of the lapper carriage 9, the width of the fibre web 6, and the speed of advance of the delivery belt 8, there will be found at each point along the length of the fleece 16 formed on the delivery belt 8, a number S of superposed fibre web segments, corresponding to S/2 reciprocatory movements of the lapper carriage 9.

In FIG. 5, the carding machine 1 is only partially and very schematically represented. The carding machine 1 comprises a carding drum 17 turning during operation in the direction indicated by an arrow 18 and carrying, at its periphery, a layer of fibres 19 which is constantly renewed by means which are not represented. Part of the layer 19 is picked up by a doffer 21 which, with the fibres taken, forms, directly or indirectly, the fibre web 6. As explained in detail in FR-A-2 770 855, the thickness of the fibre web 6 can be varied by varying the rotation speed of the drum 17 or of the doffer 21, or else by varying the distance between the drum 17 and the doffer 21. FIG. 5 more particularly illustrates the production of a fleece having, on leaving the crosslapper, a profile with tapering edges by means of a fibre web 6, which instead of having a uniform thickness, has zones Z1 and Z2 in which the surface weight of the fibre web (represented by the thickness in FIG. 5) diminishes up to a fibre web cross-section 22 and then increases again. These zones Z1 and Z2 are positioned along the length of the fibre web 6 in such a way that the lapper carriage 9 places these along the left edge and right edge respectively of the fleece 16. The fiber web cross-section 22 having the smallest surface weight coincides with the corresponding edge of the fleece 16.

The needle loom 3, installed downstream of the crosslapper 2 and in particular of its delivery belt 8 relative to the direction of circulation 23 of the latter, transforms the intermediate fleece 16 constituted of superposed segments of fibre web 6 into a consolidated fleece 24 which is much more compact and hence much less thick. The width 26 of the consolidated fleece 24 is slightly reduced in comparison with the width 27 of the intermediate fleece 16. The consolidated fleece 24 is then transported, for example, to a storage area.

According to the invention, the consolidated fleece 24 passes a measuring station 28 situated downstream of the needle loom 3 relative to the direction of movement 29 of the consolidated fleece. In a manner not represented in detail, the measuring station 28 is equipped with a means for detecting a physical magnitude at several points across the width of the consolidated fleece 24. This may be a series of individual detectors aligned according to the width of the consolidated fleece 24. It can also be a single detector periodically performing a transverse travel above or below the consolidated fleece 24 to sense the transverse profile of the fleece with regard to the physical magnitude to which the detector is sensitive. The physical magnitude in question is preferably, but not restrictively, the permeability of the consolidated fleece 24 to a radiation which can be light radiation, X-radiation, γ-radiation etc. This permeability is in fact relatively easy to measure with precision and gives a faithful image of the surface weight of the fleece at each measurement point. If needed, a factor of correspondence between the permeability and the surface weight can be used with reference to the type of fibres or of a mixture of fibres making up the fleece. Such measuring stations, comprising a row of detectors, or a single (so-called "travelling") detector movable along a measurement stroke, are commercially available and will therefore not be described further.

The measurement station 28 provides a measurement signal in analog or digital form which is transmitted by a line 31 to a processing unit 32. A terminal 33, also connected to the unit 32, allows the operator to input the reference profile desired for the consolidated fleece 24.

The processing unit 32 can be, apart from the improvements which will be described as part of the present invention, that already described in FR-A-2 770 855 to coordinate the operations of the carding machine and of the crosslapper for the purpose of profiling the fleece produced.

The installation thus comprises a connection means 34 between the processing unit 32 and the carding machine 1 for controlling the carding machine 1 from the processing unit 32 and a two-way connection 36 between the processing unit 32 and the crosslapper 2 for controlling the crosslapper 2 from the processing unit 32.

FIG. 6 shows points $P_1$ to $P_{19}$ corresponding to nineteen measuring points distributed over the width of the measuring station 28, as well as fibre web cross-sections $E_1$ to $E_{17}$ distributed along the fibre web length deposited as a result of one reciprocatory movement cycle of the lapper carriage 9 of the crosslapper. Each fibre web cross-section $E_1$ to $E_{17}$ coincides with a respective one of the measuring points $P_2$ to $P_{18}$. The extreme measuring points $P_1$ and $P_{19}$ are each situated just beyond a respective one of the edges of the reference profile and therefore do not correspond to any fibre web cross-section E. The measuring points $P_2$ and $P_{18}$ are located very close to the respective edge of the reference profile. The control of the profile will aim, amongst other things, for each real profile edge detected to be kept between the measuring points $P_1$ and $P_2$ for the left edge and between the measuring points $P_{18}$ and $P_{19}$ for the right edge respectively.

Another aim of the profile control will be that the surface weight recorded at each of the measuring points $P_2$ to $P_{18}$ should be as close as possible to that resulting from the reference profile at that point.

FIGS. 3 and 4 illustrate that a rectangular profile of the intermediate fleece 16 (FIG. 3) in general tends to give, after needling, a profile with over-thickened edge zones 37 (FIG. 4) which are quite undesirable if the user wishes to produce a consolidated fleece which is as uniform as possible, for example with a reference profile such as that illustrated in FIG. 7. Obtaining a profile as close as possible to the reference profile of FIG. 7 generally necessitates the production of an intermediate fleece 16 having the profile represented in FIG. 8, i.e. with tapering lateral edges. This is preferably achieved by making each fibre web segment thinner as described with reference to FIG. 5 in connection with the zones $Z_1$ and $Z_2$. FIG. 9 illustrates, by way of example, a certain fibre web length 6 corresponding to one movement cycle of the lapper carriage to obtain such an intermediate fleece profile, the different fibre web cross-sections $E_1$ to $E_{17}$ being intended to correspond to the measuring points $P_2$ to $P_{18}$ which also appear in this figure.

FIG. 10 is an example of a flow-chart for implementation of the control process. This begins with a step 41 of reading the reference profile defined by the reference values $P_{2c}$, $-P_{18c}$, desired for the measurement points $P_2$–$P_{18}$ respectively, then a step 42 of reading the real measurements, $P_1$–$P_{19}$. Two successive comparisons 43 and 44 are then carried out to check that $P_1$ is equal to 0 and $P_2$ is above 0, in other words, that the left edge of the real profile is indeed situated between the measuring points $P_1$ and $P_2$. If the answer to both these comparisons is yes, an updating step 46 is carried out and, if necessary, correction of the surface weight $e_5$ of the fibre web in the cross-section $E_5$ by applying the expression:

$$e_5=e_5+2(P_{2c}-P_2)/S$$

in which $e_5$ is the surface weight of the fibre web in the cross-section $E_5$ and S is the number of superposed fibre web segments in the thickness of the fleece. The correction is distributed throughout all the movement cycles of the lapper carriage, hence the division by S for the elementary correction. As one movement cycle of the lapper carriage produces two superposed segments of which only one will be corrected, it is nevertheless necessary, in this example, to multiply by two the thickness correction term as it appears in the above formula. FIG. 6 clearly shows why, with the system of correspondence which has been chosen, correction of the surface weight at point $P_2$ of the fleece necessitates the correction of the section $E_5$ of the fibre web.

Two successive comparisons 47 and 48 are then carried out to check that measurement $P_{18}$ is above 0 and measurement $P_{19}$ is equal to 0, in other words, that the right edge of the fleece is indeed situated between the measuring points $P_{18}$ and $P_{19}$. If so, the surface weight $e_{14}$ at the measuring point $P_{18}$ is re-updated and if necessary corrected in a step 49 which consists of applying a formula similar to that of step 46 but involving the discrepancy between the reference surface weight $P_{18c}$ and the detected surface weight $P_{18}$.

An updating step 51 is then carried out and, if necessary, correction of the surface weight for all the other cross-sections of the fibre web 6, in a step 51 with, for each point, application of a formula similar to that already described for step 46 with reference to the difference recorded at the corresponding measurement point. A step 52 of correspondence is then carried out, which consists of recalculating, for the reasons explained further on: a) the position occupied by the lapper carriage when the fibre web section being worked by the arranging unit (doffer 21) is that intended to be located on the axis of the fleece 24, ii) the new fibre web length to be produced between two successive passages of the lapper carriage past this position, and iii) the position of the sections $E_1$; $-E_{17}$ along this length.

The new values of $e_1$ to $e_{17}$ are each transmitted, at the appropriate time-point, to the carding machine 1 via the connection 34 (FIG. 1) to give the motor 52 driving the doffer 21 (FIG. 5), at each time-point, the speed which is appropriate to produce the corresponding surface weight e.

If the answer to one of the comparisons 43 or 44 is negative, the software executes a step 53 of repositioning the lateral edges of the fleece and in particular the left edge of the fleece by application of the formula ($L_{NG}=L_{NG}\pm\Delta L_{NG}$) so as to tend to bring the left edge of the fleece back between the measuring points $P_1$ and $P_2$. In this formula:

$L_{NG}$ is the position of the left edge of the fleece; and $\Delta L_{NG}$ is the variation applied to this position.

The software will then pass directly to step 51, thus by-passing the steps 46 and 49 of updating the surface weights at the edges of the fleece since these edges or at least one of them has proved to be wrongly positioned. The correspondence step 52 is then carried out, as the repositioning of the edges of the fleece has generally modified: i) the position of the lapper carriage for which the fibre web cross-section passing through the arranging unit is intended to be located in the centre of the fleece, and/or ii) the length of the superposed fibre web segments making up the fleece, as well as iii) the position of the cross-sections $E_1$ to $E_{17}$ along the fleece.

If the result of either of the comparisons 47 or 48 is negative, the method then also passes to step 53 for calculation of a new position of the right edge of the fleece ($L_{NR}=L_{NR}+\Delta L_{NR}$), in which:

$L_{NR}$ is the position of the right edge of the fleece $\Delta L_{NR}$ is the variation applied to this position.

The method then passes directly to step 51, thus bypassing step 49 of updating the surface weight $e_{14}$ at the right edge of the fleece, then to the correspondence step 52.

The re-updated values $L_{NG}$ and $L_{NR}$ calculated at step 51 are converted into commands transmitted by the processing unit 32 to the crosslapper 2 by the connection 36 to correspondingly move the stroke ends of the lapper carriage 9 (FIG. 5) of the crosslapper.

After step 51, and after a sufficient length of time has elapsed for the consolidated fleece 24 passing the measuring station 28 to be affected by the modifications ordered in the carding machine 1 and/or in the crosslapper 2 resulting from execution of the software which has just come to an end, the software returns to the reading step 41.

FIG. 11 illustrates a reference profile comprising two flat zones 57 of different surface weights separated by a zone of gradual transition 58. FIG. 12 illustrates the profile of the intermediate fleece 16 which will then be obtained by application of the method.

The invention further relates to an initialization method intended to give the processing unit 32 precise knowledge of the position which will be taken in the fleece width by a fibre web cross-section which is being subjected to the effect of the arranging unit which determines the surface weight of the fibre web produced. In the example chosen, the fibre-arranging unit is the doffer 21 and the cross-section being subjected to the effect determining the surface weight of the fibre web is the cross-section designated by the reference 59 in FIG. 5. In other words, the effectiveness of the method necessitates precise knowledge of where this cross-section 59 will be positioned in the width of the fleece 16.

For this purpose, the initialization step includes the production, in one fibre web cross-section, of deliberate defects or "pseudo-defects" each time the lapper carriage 9 passes a specific position in its reciprocatory movement cycle. The defects 61 are all located in the same position relative to the width of the intermediate fleece 16, as illustrated in 62 for an axial defect in FIG. 13, and this results in a longitudinal defect 63 after needling (FIG. 14). More particularly, this defect 62, initially off-centered as represented in FIGS. 3 and 4, is detected at the measuring station 28 and the processing unit 32 sends the carding machine 1 a signal producing a phase-shift of the defects 61 until the pseudo-defect 63 is located on the axis 64 of the consolidated fleece 24. At this stage, the processing unit 32 has precisely determined the position of the lapper carriage 9 when the fibre web cross-section located in the position 59 is a section $E_1$ of the fibre web, intended to be located on the fleece axis. The positions of the lapper carriage 9 when the other sections $E_2$ to $E_{17}$ pass into the position 59 are deduced therefrom.

After initialization the processing unit 32 detects predetermined positions of the lapper carriage 9 as indicators of the presence of a respective one of sections $E_1, \ldots, E_{17}$ in the position 59 where the local surface weight of the fibre web is controlled.

In the preceding examples, control of the transverse profile of the fleece normally has the effect of controlling the longitudinal profile depending on each longitudinal line of the consolidated fleece 24 corresponding to one of the measurement points P2 to P18. In other words the surface weight will be adjusted to a respective constant value along each line P2 to P18.

However, if the speed of the doffer 21 is acted upon, the speed of the fibre web leaving the carding machine must be adapted at the same time. These variations in speed do not raise any problem if the average speed of the doffer is constant, as they can then be compensated for by a different displacement law of the storage carriage 13 of the crosslapper. On the other hand, if the variations in speed of the doffer 21 lead to a variation in its average speed, this results in the necessity of adapting the speed of the delivery belt 8 of the crosslapper and thus the speed of all the machinery located downstream.

If it is desirable to avoid such a variation in the average delivery speed whilst adjusting a parameter modifying the instantaneous speed at the outlet of the carding machine at a given time point, it is possible to ensure that the references $e_{2c}$;–;$e_{18c}$ are fixed, not as absolute values but as a percentage. But then the regularity of the longitudinal profile is no longer guaranteed.

The example of FIG. 15 remedies this drawback. It will be described only with regard to its differences relative to the previous examples. The processing unit 32 calculates the sum $e_s$ of the surface weights $e_1$;–;$e_{17}$ detected to record the profile of the fleece. In case of a discrepancy between the sum $e_s$ and a reference, the processing unit 32, via a connection 71, instructs a longitudinal regulator 72 placed between the charger 73 and the inlet to the carding machine 1 to control the mass flow rate of the fibres at the inlet to the carding machine. The average weight of the fibres delivered by the carding machine per unit of time will thus be adjusted. The regulator 72 can be a weighing belt known per se, or a device operating by way of a density measurement by means of X-rays, also known per se. The regulator normally has the function of instructing the input units (the "feeding apparatus") of the carding machine to ensure constant production of the carding machine, independently of variations in certain parameters of the fibres. According to the invention, the unit 32 modifies an operation reference of the regulator 72 to correct the discrepancies in average surface weight detected upon leaving the needle loom.

In case the reference transverse profile is a uniform profile as represented in FIG. 7, the control of the longitudinal profile could be based not only on the sum of all the surface weights, but on a single one of these, or on the sum of only a few of them.

Thus, in the example represented in FIG. 15, the transverse profile is controlled by adjusting the instantaneous speed of the doffer in such a manner that its average speed over a movement cycle of the lapper carriage is constant, and independently of that, the longitudinal profile is adjusted by adjusting the fibres flow rate at the carding machine inlet. The independence of these two adjustments does not exclude, as has been seen, the use of the same detection to evaluate the results obtained on the consolidated fleece.

Needless to say, the invention is not limited to the examples described and represented.

The invention is compatible with the other means of varying the surface weight of the fibre web upstream of a crosslapper described in FR-A-2 770 855.

Reference profiles other than those in FIGS. 7 and 11 can be produced with several flat zones separated by shoulder formations, or any other desired irregular shapes, which may or may not be symmetrical, within the limits of the precision permitted by the number of measuring points and by the capacity of the fibre web to pass suddenly from one surface weight to another by variation in the rotation speed of the doffer 21 or any other means included in the carding machine 1 and/or the crosslapper 2 to control the surface weight of the fibre web produced.

The embodiment of FIG. 15 is applicable if the transverse profile is controlled by means of a variation in the speed of the lapper carriage on both sides of a constant average speed.

What is claimed is:

1. A method for controlling the transverse profile of a non-woven fleece in an installation for production of said fleece from a fibrous product (6), in which, at a measuring station (28) a physical magnitude of the fleece is detected and on the basis of the detected value the profile of the fleece is corrected by adjusting an operation parameter of at least one fibre-arranging unit (9, 21) situated in the installation upstream of the measuring station, characterized in that:

at the measuring station (28), the physical magnitude is detected at several points ($P_1$–$P_{19}$) across the width of the fleece (24) so as to record a transverse profile of the fleece;

in case of a discrepancy between the profile recorded and a reference profile, the operation parameter is corrected, when said arranging unit (9, 21) is working fibres which will be located at a point on the width of the fleece where the profile discrepancy appeared.

2. A method according to claim 1, characterized in that the instantaneous profile is recorded downstream of a fleece consolidation machine (3), in particular a needle loom, and said arranging unit (21) whose adjustment is modified, is located upstream of the consolidation machine (3).

3. A method according to claim 1, characterized in that the measuring station (28) is situated downstream of a crosslapper (2) forming part of the production installation.

4. A method according to claim 3, characterized in that said at least one unit (9, 21), whose adjustment is modified belongs at least partly to the crosslapper (2), and includes in particular a lapper carriage (9) whose speed of movement is adjusted relative to the speed at which the fibrous product (6) leaves this carriage (9), so as to stretch or compress the fibrous product (6) to a greater or lesser degree on leaving the lapper carriage (9).

5. A method according to claim 3, characterized in that said at least one unit (9, 11), whose adjustment is modified belongs at least partly to a fibre web production machine, in particular a carding machine (1), installed in the production installation upstream of the crosslapper (2).

6. A method according to claim 5, characterized by taking into account a rule of correspondence between the longitudinal position of the fibres (6) being worked by said unit (21) and the future transverse position of these fibres in the fleece (24).

7. A method according to claim 6, characterized in that the position of the lapper carriage (9) of the crosslapper (2) in its reciprocatory movement cycle is determined when the particular feature (61) passes the arrangement unit (21), then the correspondence rule consists of using the position of the lapper carriage (9) as reference for the transverse position in the fleece that will be taken by each fibrous product cross-section (59) passing the arranging unit (21).

8. A method according to claim 6, characterized in that to establish this rule of correspondence, an initialization step is carried out with the help of a particular feature (61) of the fibrous product of which there are determined on the one hand the longitudinal position along the fibrous product during transit across said unit (21) and on the other hand the transverse position (63) in the fleece produced (24).

9. A method according to claim 8, characterized by causing the occurence of the particular feature (61) on the fibrous product (6) to be repeated while causing its longitudinal position on the product to be phase-shifted until the particular feature has a predetermined transverse position, in particular a central position, downstream of the crosslapper (2).

10. A method according to claim 8, characterized in that said transverse position is determined with the help of means (28) also serving to detect said physical magnitude.

11. A method according to claim 8, characterized in that said particular feature is produced in the form of a local particular feature (61) of the longitudinal profile of the fibrous product (6).

12. A method according to claim 11, characterized in that the local particular feature (61) is produced with the help of said unit (21).

13. A method according to claim 3, characterized in that said unit (21) whose adjustment is modified is located upstream of the crosslapper (2).

14. A method according to claim 3, characterized in that in case of a discrepancy between the width of the profile recorded and the width of the reference profile, the end points of the lapping stroke ($L_{NG}$, $L_{NR}$) of the crosslapper (2) are corrected.

15. A method according to claim 1, characterized in that, after having made a profile correction, a correction is made (52) to a rule of correspondence between the longitudinal positions of the fibrous product cross-sections (59) passing the arranging unit (21) and their future position in the width of the fleece (24).

16. A method according to claim 1, characterized in that the average surface weight of the fleece is assessed and in case of a discrepancy a fibre entry flow rate is adjusted upstream of the arranging unit (9, 21).

17. A method according to claim 16, characterized in that the fibre flow rate entering a carding machine (1) is adjusted by means of a longitudinal regulator (72).

18. A method according to claim 16, characterized in that the average surface weight is assessed by adding the values of said physical magnitude at some, at least, of said points on the width of the fleece.

19. A method according to claim 1, characterized in that the average value of the parameter of adjustment of the arranging unit is varied, in particular the average speed of rotation of a carding machine doffer (21), for the purpose of controlling the longitudinal profile.

20. An installation for production of a fleece of non-woven fibres, comprising fibre-arranging units (21, 9), detection means (28) for measuring a physical magnitude of the fleece (24) passing a measuring station, and control means (32) receiving a signal provided by the detection means (28) and providing at least one of the arranging units with a modified control signal in case of a discrepancy between the physical magnitude read and a reference value, characterized in that:

the detection means (28) are designed to measure the physical magnitude at different points ($P_1$–$P_{19}$) on the width of the fleece (24); and the control means compare the physical magnitude of each point with a reference related to this point, and in case of a discrepancy at one point, apply a corrected instruction when the arranging unit (21) is working fibres intended to be located at said point.

21. An installation according to claim 20, characterized in that the detection means (28) are positioned downstream of a consolidation machine (3), in particular a needle loom, and said at least one fibre-arranging unit (21) is situated upstream of the needle loom (3).

22. An installation according to claim 20, characterized in that said at least one arranging unit (21) belongs at least partly to a fibre-web production machine, in particular a carding machine (1).

23. An installation according to claim 22, characterized in that the fibre-web production machine (1) is upstream of a crosslapper (2) itself situated upstream of the consolidation machine (3).

24. An installation according to claim 22, characterized in that said at least one arranging unit comprises:

a first arranging unit (21) belonging to a fibre web production machine, in particular a carding machine (1), installed upstream of the consolidation machine (3), to adjust the specific weight of the fleece at different points across its width;

a second fibre-arranging unit made up of a lapper carriage (9) of a crosslapper (2), situated between the carding machine (1) and the consolidation machine (3), and whose stroke ends ($L_{NG}$, $L_{NR}$) can be adjusted to adjust the width of the fleece (24).

25. An installation according to claim 20, characterized in that said at least one arranging unit (9) belongs at least partly to a crosslapper (2) and comprises in particular a lapper carriage (9) of which the ratio between the speed of movement and the speed at which the fibrous product (6) leaves this carriage (9) is adjustable, in such a way as to stretch or compress the fibrous product (6) to a greater or lesser degree on leaving the lapper carriage (9).

26. An installation according to claim 20, characterized in that it furthermore comprises longitudinal profiling means (71, 72) to control the average surface weight of the consolidated fleece to keep this weight approximately constant following the longitudinal direction of the fleece.

27. An installation according to claim 26, characterized in that the longitudinal profiling means comprise means (72) for adjusting the weight of fibres introduced into a carding machine (1) upstream of the arranging unit (9, 21).

* * * * *